United States Patent [19]

Deards et al.

[11] 3,938,728

[45] Feb. 17, 1976

[54] COLLAPSIBLE CONTAINER

[75] Inventors: Henry Charles Deards; Nigel Evans Pickford, both of Welwyn, England

[73] Assignee: Imperial Chemical Industries Limited, London, England

[22] Filed: Aug. 19, 1974

[21] Appl. No.: 498,851

[30] Foreign Application Priority Data

Sept. 6, 1973 United Kingdom ..... 41890/73
May 10, 1974 United Kingdom ..... 20755/74

[52] U.S. Cl. ..... 229/14 B; 24/3 H
[51] Int. Cl.[2] ..... B65D 85/72; B65D 5/40
[58] Field of Search..... 229/14 B, 14 BA, 14 BE, 229/14 BL, 14 BW, 23 BT; 24/30.5, 3 H, 255 HR

[56] References Cited

UNITED STATES PATENTS

| | | | |
|---|---|---|---|
| 2,556,321 | 6/1951 | Demtom | 229/14 BW |
| 3,065,895 | 11/1962 | Lipschutz et al. | 229/14 B |
| 3,135,967 | 6/1964 | Stephens | 24/3 H X |
| 3,137,433 | 6/1964 | Lipschutz et al. | 229/14 BE |
| 3,297,226 | 1/1967 | Scholle | 229/14 B |
| 3,539,360 | 11/1970 | Wood | 229/14 B X |

*Primary Examiner*—Davis T. Moorhead
*Attorney, Agent, or Firm*—Cushman, Darby & Cushman

[57] ABSTRACT

A container assembly for biologically processing liquids, comprising an open-top box, a free-standing, block ended plastics-film sleeve fitted within the box, and a liquid-tight plastics-film liner, the depth of the box being not more that one-half that of the sleeve, and the sleeve preferably having a stiffening attachment or enclosure at its base, to fit the box.

1 Claim, 10 Drawing Figures

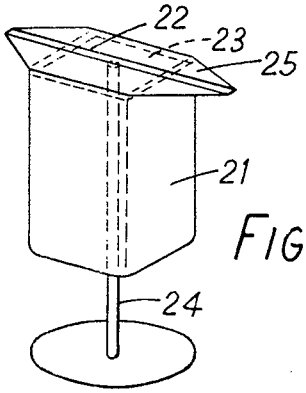
FIG. 6
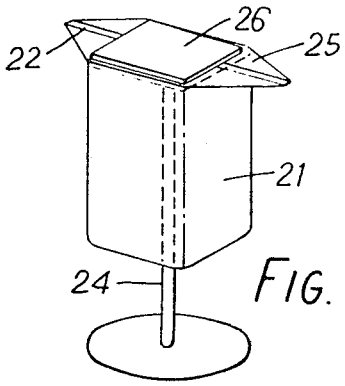
FIG. 7
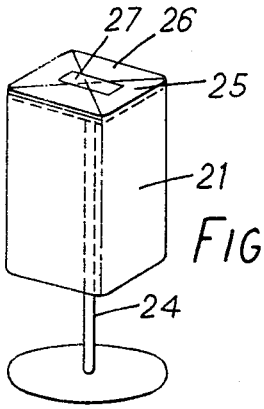
FIG. 8
FIG. 9
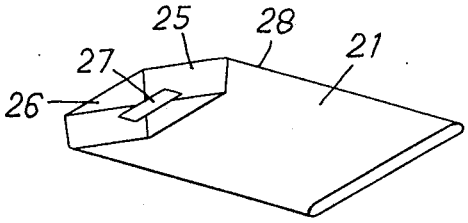
FIG. 10
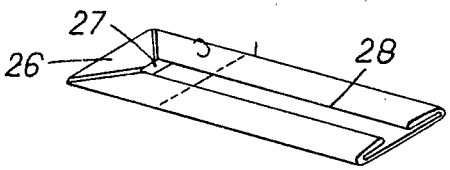

COLLAPSIBLE CONTAINER

This invention relates to a collapsible container assembly, and especially to a container assembly suitable for use in processes such as the home-brewing of wine and beer, and to a method of using such a container assembly.

In accordance with the invention, a collapsible container assembly comprises an open-topped box, a free-standing but collapsible plastics-film sleeve fitting closely within the box at its base, and a water-tight plastics-film liner within the sleeve, the depth of the box being no more than one half of the depth of the sleeve, the sleeve being supported within the base of the box so as to allow it to stand vertically therefrom, and the plastics-film liner having a perimeter of length not significantly less than that of the inner perimeter of the sleeve, and being formed of plastics film that is thinner and more flexible than that from which the sleeve is formed.

The perimeter of the sleeve preferably does not exceed in length the perimeter of the box interior; it may with advantage be slightly less, so that the sleeve will fit easily into the box. The perimeter of the liner preferably does not exceed in length that of the inner perimeter of the sleeve sufficiently to cause much creasing when it is fitted within the sleeve. Ideally, the liner perimeter is of length equal to the inner perimeter of the sleeve, and since it is impossible to achieve exact and constant equality in production, the liner perimeter will sometimes be somewhat the smaller of the two when this ideal is adopted for production. However, such departure from exact equality, within the usual tolerances, is not significant, since it is easily compensated by slight stretching of the liner when it is filled. The difference should not be so great that the filled liner will flop loosely in the sleeve.

For ease of manufacture, the box is preferably a rectangular box and the plastics-film sleeve has the form of a block-bottom bag, the flat bottom of which is essentially of the same size and shape as the bottom of the box. It is essential that the sleeve be supported within the base of the box, and in one form of the invention it is directly attached to the base of the box. In a more preferred form of the container assembly of the invention, however, when the sleeve has a block-bottom shape, the base of the sleeve is provided with a stiffening attachment or enclosure such that the base so stiffened will fit accurately into the box member of the assembly. The stiffening member may be, for example, a piece of cardboard of the same shape as the base of the box but slightly smaller, so that the base of the bag will fit snugly within the box.

The plastics-film liner of the container assembly is provided for reasons of hygiene, since the liner can be disposed of and replaced as required. Moreover, when such liners are made from tubular film, as is generally the case, their inner surfaces are substantially sterile until the liners have been opened. Because of the presence of the liner, the sleeve need not necessarily be made water-tight, but there are obvious advantages to be had by making it water-tight, since this allows for accidental leakages from the liner.

The container assembly of the invention is particularly useful for providing a fermentation bag for use in the domestic preparation of wine or beer, the fermentation bag being constituted by the liner. It may also be used for the domestic preparation of other products prepared by the biological processing of liquids, such as yoghurt and soft cheese. For all these processes the use of a liner, particularly with a means for closing its mouth, greatly facilitates the provision of any necessary conditions of substantial freedom from contamination.

Thus, the present invention also provides a method of biologically processing a liquid in which the processing is carried out in the liner of a container assembly as hereinbefore described.

The container assembly of the present invention is found to stand stably in use, and may be conveniently stored when not in use, since the sleeve may be collapsed into the box so that the empty container occupies only a fraction of the space that would be occupied, for example, by a rigid supporting vessel for a fermentation bag. Moreover, the box member may function also as a sales package, without further packaging being provided, and may contain, not only the folded-down sleeve, but also any of the further equipment or ingredients for the process in which it is primarily intended to be used.

The present invention therefore further provides a kit of parts for use in the domestic preparation of a product by the biological processing of a liquid, the kit including a container comprising an open-topped box and a sleeve as hereinbefore described, a plastics-film liner therefor, and a means for closing the mouth of the liner such that it will function essentially as a non-return valve to allow the escape of excess gas from the liner. The kit may also include any or all of the ingredients for the biological process. It may further include a tapping device, particularly when the kit is intended for use in an alcoholic fermentation process; one suitable form of such device will be described hereinafter.

The kit is preferably provided with an enclosing cover; this may conveniently be a lid for the box member, the sleeve being collapsed into the box, and the other parts of the kit being placed upon it, or within its folds, before the lid is closed. The lid may be a detachable lid, or may be hinged to one side of the box member. Alternatively, the kit may be contained in, for example, a separate case or a flexible pouch.

When the function of the box member of the container is only to provide stability for the filled container, its depth preferably does not exceed one quarter of the depth of the sleeve; generally a depth equal to about one-seventh to one-fifth of the depth of the sleeve is sufficient. When the box member is also required to house further equipment and, more particularly, ingredients (which may be bulky) for the intended process, a greater depth may be needed, up to one half of the depth of the sleeve. A still greater depth would of course be possible, but much of the advantage of the container assembly, particularly in saving storage and transport space, would then be lost.

Some preferred forms of the container assembly of the invention will now be more particularly described by way of example with reference to the accompanying drawings, of which:

FIGS. 6 to 8 show stages in the making of a sleeve member of the type having a stiffened base for supporting it within the box member; and FIGS. 9 and 10 show stages in the folding of such a sleeve member to fit it into the box member of the container assembly, for storage until it is required for use.

Figure 1:
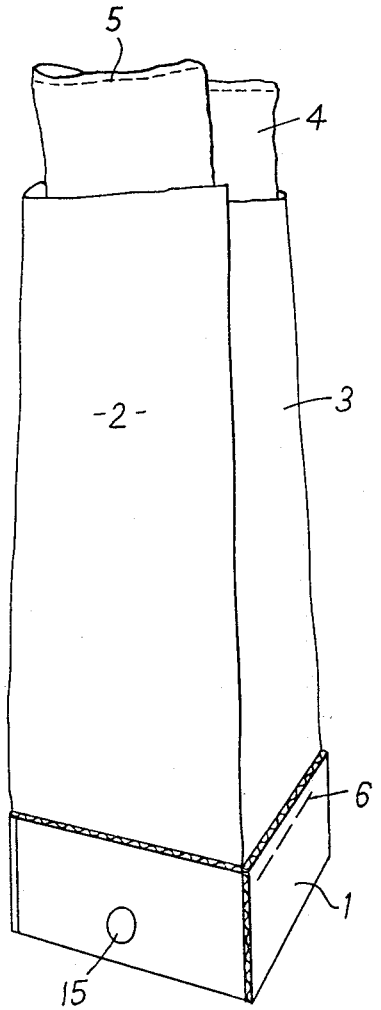
FIGS. 1 and 2 show details of a container assembly in which the sleeve member has the form of a block-bottom bag attached at its base to the base of the box member.

In FIG. 1: 1 is the open-topped, rectangular box component of the container, in this case a square box, optionally provided with a detachable lid (not shown), for example a lid of the same shape as, and fitting over, the box; 2 is the sleeve component, formed from a length of gusseted, heavy-duty tubular film, the depth of the gussets, 3, being half the flat width of the gusseted film; and 4 is a liner, which is a length of non-gusseted tubular film, sealed at each end but provided at its upper end with a line of perforations, 5, along which the sealed end can be torn off before the liner is filled. The gusseted sleeve opens to the shape and size of the base of the box. The liner, 4, has a lay-flat width nominally equal to half the length of the inner perimeter of the sleeve. The box, 1, is suitably formed from a blank of cardboard, for example from a corrugated laminate, which may be joined by stapling, as shown at 6.

Figure 2:
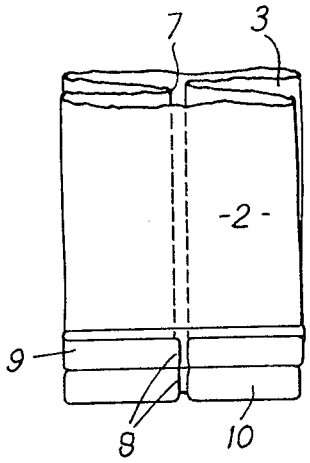

In FIG. 2: 2 is again the sleeve, flattened at its end and with the two inner gusset folds, 7, slit for a short distance, as shown at 8, allowing two flaps, 9 and 10, to be folded back in opposite directions. To fasten the sleeve to the base of the box, these flaps 9 and 10 are laid flat across the centre of the base portion of the box blank, before it is folded, and are stapled in position. After the box has been folded and secured, the sleeve is opened out above the flaps 9 and 10 to the form of a block-bottomed bag. The upper part of the sleeve may then be collapsed to its flat, gusseted form and folded down upon its flat base, the box closed, and the container stored in this form until it is required for use, when the sleeve may readily be opened out and a liner inserted.

Figure 3:
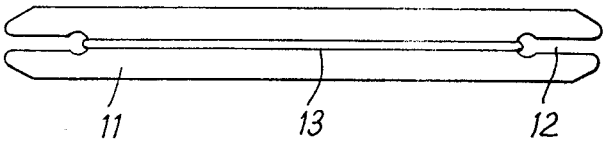
FIGS. 3 and 4 illustrate the use of a device acting as a non-returnable valve for closing the liner when the container assembly is in use.
Figure 4:
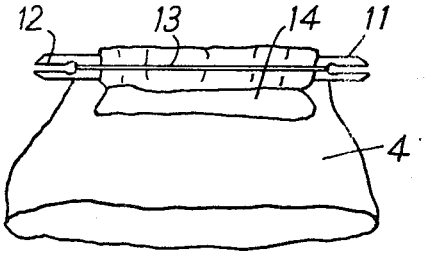

In FIGS. 3 and 4: 11 is a flat strip of rigid material suitably of a plastics material, such as rigid polyvinyl chloride, or of wood or metal, provided at each end with a slot, 12; and 13 is an elastic band passing round the strip 11 and held in the slots 12. FIG. 4 shows the top of a liner, 4, which has been closed by flattening its open end and folding it over the strip 12, turning the strip, with the end of the liner folded upon it, down upon the mouth portion, so that the liner is folded again, and securing it by means of the band 13. The mouth edge of the liner is shown at 14. When the liner has been inserted into the container, filled, and closed in the manner described, the closure may conveniently rest upon the top of the sleeve member of the container, so that the mouth of the liner will be readily available for opening when required. The filled assembly stands stably without support for as long as may be required.

Figure 5:
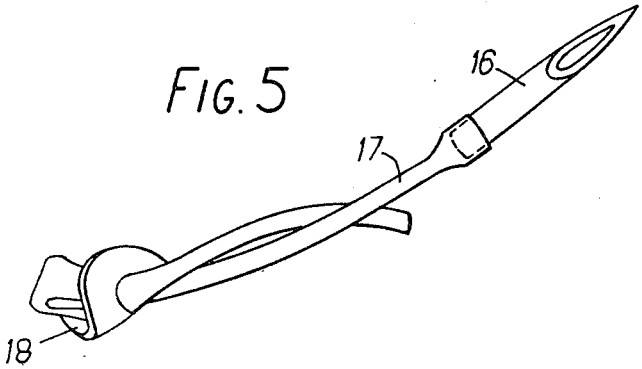
FIG. 5 shows a device for tapping the liquid from the container.

At 15 in FIG. 1 is shown a hole in the wall of the box member of the container through which the sleeve member and the liner may be tapped, by means of the device shown in FIG. 5. This device comprises a rigid, sharply-pointed, hollow probe, 16, suitably made of metal or rigid plastics material such as nylon, a polyacetal or polystyrene, a flexible tube, 17, attached thereto, suitably of plasticized polyvinyl chloride, and a releasable clip, 18, placed upon the flexible tube. In this case the clip is a bent steel washer placed upon a reflex bend in the flexible tube, to hold it in this position, liquid thus being prevented from flowing round the bend. It is found that, at least when a liner of polyethylene film is used, the probe member of the device may be pushed through the wall of the container and the liner without escape of liquid, other than through the probe itself, provided that the liner is formed of film of more than a minimum thickness. For polyethylene film this minimum is about 38 m$\mu$. The device may be used for tapping the liner even when the wall of the sleeve member of the container has previously been pierced in use. In packing the kit, the sleeve is folded down into the box as previously described, and the other parts may be placed upon it.

In a particularly preferred embodiment of the present invention, the sleeve member of the container assembly has a stiffened base and is formed from a length of non-gusseted tubular film, by sealing one end thereof, opening the sealed sleeve into block-ended form, folding the resulting "ears" of the sealed end down upon a stiffening member placed against the block end, and fastening them in this position, preferably by means of adhesive tape. This method is illustrated by FIGS. 6 to 10 of the accompanying drawings.

In FIG. 6 the sleeve member, 21, which again may be, for example, of thick tubular film of polyethylene, is shown after its end has been sealed, at 22, and placed upon a square forming plate, 23, on a pedestal support, 24. The sleeve is positioned with the seal 22 lying along one tranverse axis of the plate, so that it extends to the tips of the ears, 25, produced by the opening-out of the sealed end of the sleeve. In FIG. 7, 26 is a square of stiff card placed upon the block end of the sleeve, opposite the former. FIG. 8 shows the sleeve with the ears 25 of the block end turned over upon the card 26, and fastened in this position by a strip of adhesive tape, 27, so that the card becomes partially enclosed in the block end.

FIG. 9 shows the sleeve with its walls flattened together, the side-folds, 28, of the original tubular film thus being restored, and with the stiffened base folded down upon one wall of the sleeve. The sides of the sleeve are then folded towards the centre of the flattened sleeve, around the covered edges of card 26 and along the same lines continuously to the top of the sleeve, as shown in FIG. 10. The sleeve may then be further folded longitudinally around its stiffened base, so that the folded sleeve may be stored within the box member of the container assembly. When the container assembly is required for use, the sleeve is removed from the box, unfolded and opened out, and the base fitted back within the box member of the assembly, when, with the liner placed within the sleeve member, the container assembly will appear essentially as shown in FIG. 1 of the drawings.

In one particular example of a sleeve member formed in the manner illustrated in FIGS. 6 to 8, the member is formed from a 370 mm length of thick (375 micron) tubular film of polyethylene having a lay-flat width of 320 mm. The stiffening insert is a 157 mm-square card, giving a base for the sleeve that will fit snugly in a 160 mm-square (internal measurement) box member. A liner particularly suitable for use within this sleeve member is formed from a 560 mm length of non-gusseted tubular film of polyethylene, 50 microns thick and of 320 mm lay-flat width, sealed at one end. Various other methods may be used for attaching the stiffening member to the end of the sleeve, or enclosing it therein. The method illustrated has the advantages of being very simply operated and of giving a water-tight bag, provided that the end seal is formed across the whole width of the end of the sleeve. These advantages are more easily attained than with the construction described with reference to FIGS. 1 and 2; a further advantage is that the construction of the box member can, of course, in the embodiment shown in FIGS. 6 to 8, be finished before the sleeve member is inserted. The sleeve and liner members of the container assembly illustrated in FIGS. 1 and 2 may be formed from the same types of tubular film of polyethylene, except that the tubular film for forming the sleeve is preferably gusseted.

Many modifications may be made in the container particularly described. For example, in the container assembly shown in FIGS. 1 and 2 it is not essential to shape the sleeve to block-bottomed form; it may be simply attached as a straight sleeve to the sides of the box. The sleeve member of the container assembly described with reference to FIGS. 6 to 10 may be formed as a block-bottom bag by a method other than that illustrated, for example by forming it from pre-gusseted tubing, and providing it with a stiffening member attached or enclosed in the manner that is most convenient. It is also within the scope of the present invention to use, as the sleeve member, a block-bottom bag without stiffening or attachment, provided that it fits snugly within the box member. Thus, for example, a suitable sleeve member of such form may be made by the method illustrated in FIGS. 6 to 8 of the drawings, and the stiffening member drawn out from beneath the turned-over ears of the bag after these have been seamed one to the other, to leave the bottom of the bag unsupported but held to the required shape.

Means other than that illustrated may be provided for closing the mouth of the liner, during the fermentation, to provide the effect of a non-return valve. For example, a spring clip may be used.

When the box member is formed by folding a cardboard blank, the base is preferably formed as a single panel, any overlapping or joined flaps being located in the sides of the box, as this provides a more stable structure.

The kit of parts of the present invention may be sold, optionally together with at least one or some of the processing ingredients, for use once only, or the container may be separately sold, or sold together with a liner, or a pack of liners, for repetitive use. The liners supplied are preferably sealed at each end, one end then preferably being provided with a tear-line for opening it, for example as shown in FIG. 1. A line of simple perforations will generally ensure a sufficient freedom from contamination within the liner, the inside of tubular film generally being substantially sterile as it comes from the film-making process. However, the perforations may be sealed round their edges if desired, for example by forming them by means of heated pins. Suitable liners may be easily made as closed side-seal or end-seal bags in conventional manner from tubular film by an in-line process at the film-making plant, the lines of perforations being made, respectively, adjacent to one edge fold or seal in each bag.

Although films of polyethylene or polyethylenes modified by copolymerisation are generally very suitable for use in making both the sleeve member of the container and the liner, films of other plastics material may be used if desired or to meet particular requirements in the use of the container or the liner. Film of polyvinyl chloride, for example is also a very suitable material for the sleeve.

We claim:

1. A collapsible container assembly comprising: a rectangular open-topped box; a free-standing but collapsible water-tight plastics-film sleeve fitting closely within the box at its base, the depth of the box being no more than one-half of the depth of the sleeve, the sleeve being supported within the base of the box so as to allow it to stand vertically therefrom and having the form of a block-bottom bag, the flat bottom of which is essentially of the same size and shape as the bottom of the box; and a water-tight plastics-film liner within the sleeve having a perimeter of length not significantly less than that of the inner perimeter of the sleeve, and being formed of plastics-film that is thinner and more flexible than that from which the sleeve is formed; in which the sleeve member has been formed from a length of non-gusseted tubular film by sealing one end thereof, opening the sealed sleeve into block-ended form, folding the resulting ears of the sealed end down upon a stiffening member placed against the block end, and fastening them in this position, whereby the base of the sleeve is provided with a stiffening attachment or enclosure such that the base so stiffened will fit accurately into the box member of the container assembly.

* * * * *